US007644744B2

(12) United States Patent
Fan

(10) Patent No.: US 7,644,744 B2
(45) Date of Patent: Jan. 12, 2010

(54) LID SEALING MACHINE

(76) Inventor: Jyh Huei Fan, No. 29, Lane 395, Sweiyuan Road, Fonyuan City, Taichung Hsien 42076 (TW)

( * ) Notice: Subject to any disclaimer, the term of this patent is extended or adjusted under 35 U.S.C. 154(b) by 736 days.

(21) Appl. No.: 11/403,768

(22) Filed: Apr. 13, 2006

(65) Prior Publication Data

US 2007/0251644 A1 Nov. 1, 2007

(51) Int. Cl.
*B32B 41/00* (2006.01)

(52) U.S. Cl. ..... 156/361; 156/378; 156/515; 156/543; 156/583.1

(58) Field of Classification Search ..... 156/361, 156/378, 515, 543, 583.1; 53/526
See application file for complete search history.

(56) References Cited

U.S. PATENT DOCUMENTS 4,397,709 A * 8/1983 Schwenzer ..... 156/351
4,625,498 A 12/1986 Parsons ..... 53/526
6,739,109 B1 * 5/2004 Fan ..... 53/329.3
2003/0221784 A1 * 12/2003 Dods ..... 156/361

* cited by examiner

*Primary Examiner*—George R Koch, III
(74) *Attorney, Agent, or Firm*—Charles E. Baxley

(57) ABSTRACT

A lid sealing machine includes a casing attached to a housing, a sealing device disposed in the casing, a container holder for supporting and moving containers into and out of the casing, a supply reel, a take up reel and a roller rotatably attached onto the housing for supporting a film material and for transmitting the film material from the supply reel around the roller and to the take up reel, and for moving the film material between the sealing device and the container holder, and for allowing the film material to be forced to seal the containers by the sealing device. A detecting device may be used for detecting a rotating movement of the roller and a movement of the film material relative to the housing.

1 Claim, 3 Drawing Sheets

LID SEALING MACHINE

BACKGROUND OF THE INVENTION

1. Field of the Invention

The present invention relates to a lid sealing machine, and more particularly to a lid sealing machine having a detecting or measuring device for detecting or measuring the movement or the position of film material and for allowing the film material to be precisely operated or cut to apply and to seal various recessed containers without applying any marks or patterns or identification points onto the film material.

2. Description of the Prior Art

Typical lid sealing machines comprise a supply reel for winding or supporting a continuous ribbon or web of a thin and transparent film material which may be selected from a wide range of flexible materials such as plastic, foil and paper or laminated combinations of such materials, and a take up reel for winding and receiving the film material that has been partially cut to seal the containers.

For example, U.S. Pat. No. 4,625,498 to Parsons discloses one of the typical lid sealing machines comprising a continuous ribbon or web or film material wound and supplied from a supply reel toward a take up reel, and moved through a vacuum head and/or a hot pressing or sealing device, for allowing the ribbon or web or film material to be cut and sealed onto the containers.

However, the typical lid sealing machines have no detecting or measuring devices provided therein such that the movement or the position of film material may not precisely detected or measured and such that the film material may not be precisely operated or cut to apply and to seal various recessed containers.

The present invention has arisen to mitigate and/or obviate the afore-described disadvantages of the conventional lid sealing machines.

SUMMARY OF THE INVENTION

The primary objective of the present invention is to provide a lid sealing machine including a detecting or measuring device for detecting or measuring the movement or the position of film material and for allowing the film material to be precisely operated or cut to apply and to seal various recessed containers without applying any marks or patterns or identification points onto the film material.

The other objective of the present invention is to provide a lid sealing machine including a detecting or measuring device for detecting or measuring the movement or the position of film material and for allowing various kinds of film material to be attached and operated with the detecting or measuring device.

In accordance with one aspect of the invention, there is provided a lid sealing machine comprising a housing, a casing attached to the housing, a sealing device disposed in the casing, a container holder for supporting containers to be sealed, the container holder being slidably attached to the housing and movable relative to the casing for moving the containers into and out of the casing, and a supply reel, a take up reel and at least one roller rotatably attached onto the housing for supporting a film material and for transmitting the film material from the supply reel around the roller and to the take up reel, and for moving the film material between the sealing device and the container holder, and for allowing the film material to be forced to seal the containers by the sealing device, and a detecting device for detecting a rotating movement of the roller and a movement of the film material relative to the housing, without applying any marks or patterns or identification points onto the film material, and for allowing various kinds of film material to be attached and operated with the detecting or measuring device.

The detecting device includes a photo detector attached to the housing, and a rotary member secured to the roller and rotated in concert with the roller for acting with the photo detector.

The photo detector includes a groove formed therein, and the rotary member includes an outer peripheral portion movable into and through the groove of the photo detector.

The rotary member includes a number of slots formed in the outer peripheral portion of the rotary member to form a number of blades, the slots and the blades are alternatively and uniformly formed in the outer peripheral portion of the rotary member and equally spaced from each other.

The housing includes a seat to rotatably support the roller with such as bearings, and the photo detector may be selectively attached to the seat.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
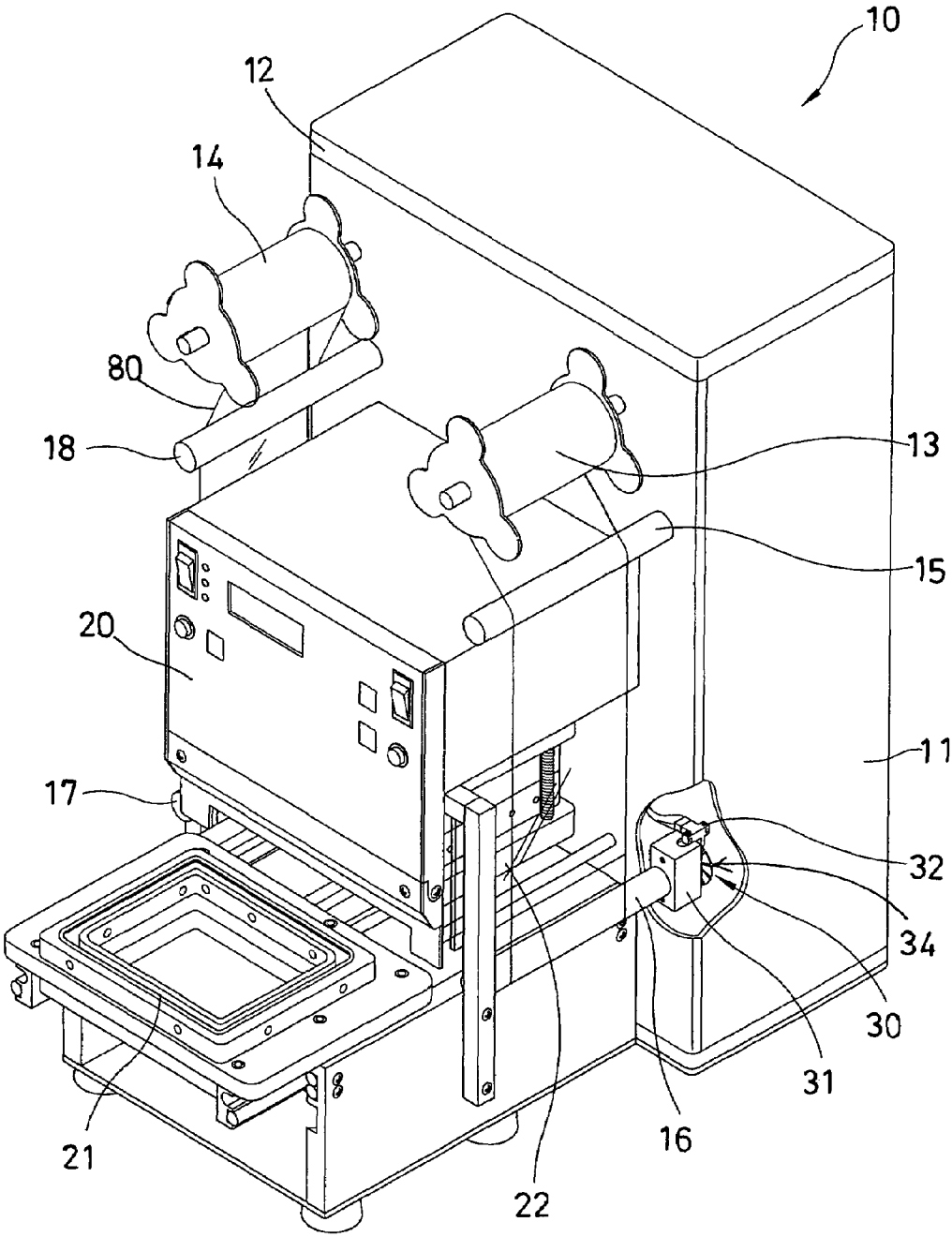
FIG. 1 is a perspective view of a lid sealing machine in accordance with the present invention.
Figure 2:
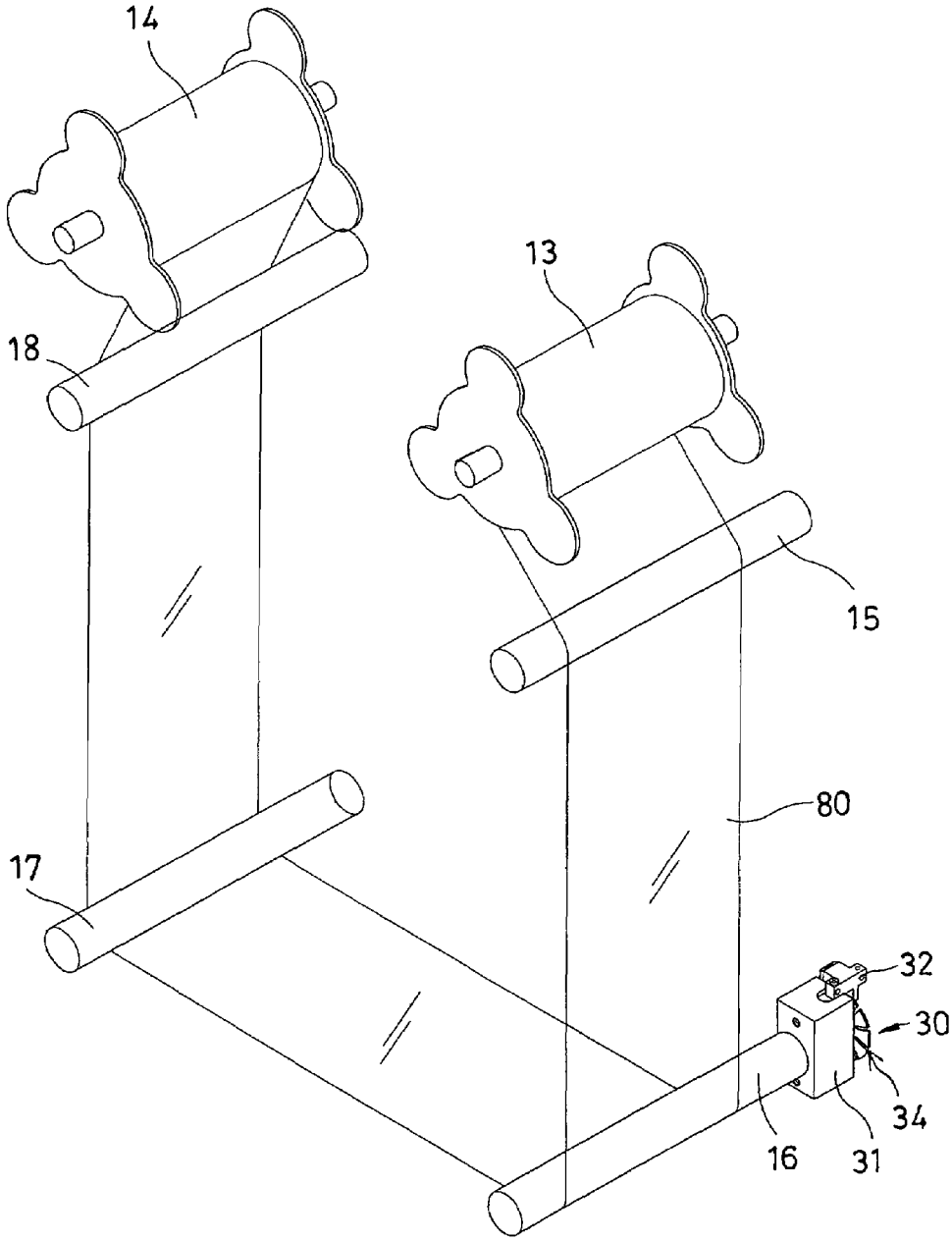
FIG. 2 is an enlarged partial perspective view of the lid sealing machine.

Referring to the drawings, and initially to FIGS. 1 and 2, a lid sealing machine 10 in accordance with the present invention comprises a machine body or housing 11 including a front portion 12, a supply reel 13, a take up reel 14, and one or more rollers 15, 16, 17, 18 rotatably attached onto the front portion 12 of the housing 11, for winding or supporting or transmitting a continuous ribbon or web 80 of a thin and transparent film material 80 which may be selected from a wide range of flexible materials such as plastic, synthetic materials, foil and paper or laminated combinations of such materials, and which may be melted or hot-pressed onto various containers (not shown).

The housing 11 includes a casing 20 attached or secured onto the front portion 12 thereof, a container holder 21 slidably attached to the housing 11 and movable into the casing 20, for supporting and moving the containers (not shown) to be sealed into and out of the casing 20, and includes a typical hot-pressing or sealing device 22 disposed in the lower portion of the casing 20 and to be located or arranged above the container holder 21. The film material 80 will be supplied from the supply reel 13 to the take up reel 14, and will be engaged over or around the rollers 15, 16, 17, 18, and will be guided to move between the sealing device 22 and the container holder 21, for allowing the film material 80 to be forced to seal the containers by the sealing device 22. The structure of the casing 20 and the container holder 21 and the sealing device 22 is typical and will not be described in further details.

The sealing machine 10 in accordance with the present invention further includes a detecting or measuring device 30 for detecting or measuring the movement or the position of film material 80 and for allowing the film material 80 to be precisely operated or cut to apply and to seal various recessed containers. For example, the detecting or measuring device 30 includes a supporting member or seat 31 attached or secured to such as the housing 11, and preferably located or disposed within the housing 11, best shown in FIG. 1, and one of the rollers 16 may be rotatably attached onto seat 31 with conventional bearings (not shown).

Figure 3:
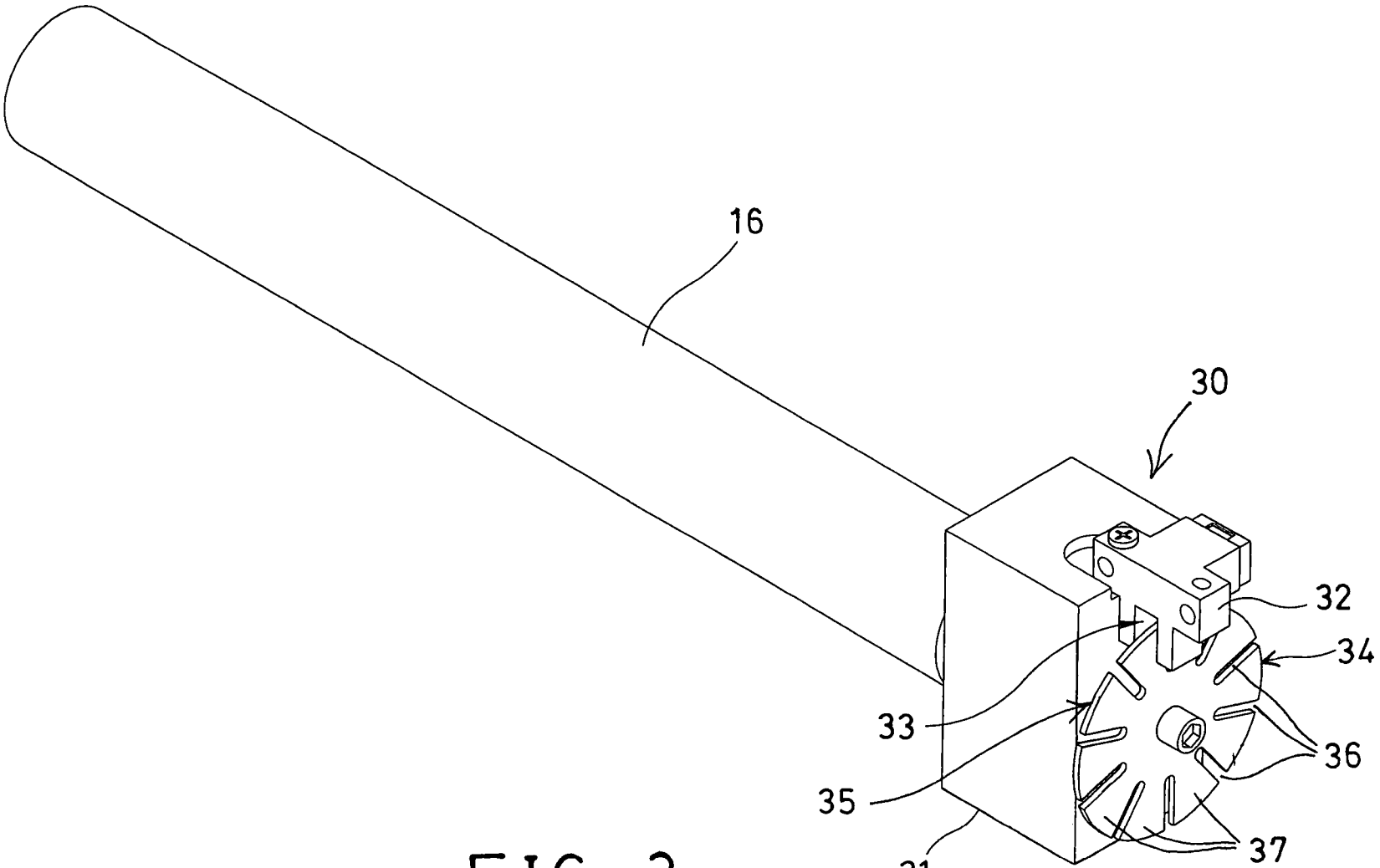
FIG. 3 is another enlarged partial perspective view illustrating the film material detecting or measuring device of the lid sealing machine.

The detecting or measuring device 30 further includes a typical light emitting and receiving device, or photo sensor or detector 32 attached or secured to the seat 31 and/or to the housing 10, and having a groove 33 formed therein, and a disc or rotary member 34 secured to the roller 16 and rotated in concert with the roller 16. As best shown in FIG. 3, the rotary member 34 includes an outer peripheral flange or portion 35 to be moved into or through the groove 33 of the photo detector 32, and includes a number of slots 36 formed in the outer peripheral portion 35 thereof to form or define a number of blades 37. The slots 36 and the blades 37 are alternatively and uniformly formed in the outer peripheral portion 35 of the rotary member 34.

The rotary member 34 of the detecting or measuring device 30 is secured to the roller 16 and rotated in concert with the roller 16 such that the rotating number of the roller 16 and thus the movement of the film material 80 may be precisely detected or measured and such that the film material 80 may be precisely operated or cut to apply and to seal various recessed containers. The slots 36 and the blades 37 are equally spaced from each other for allowing the rotating movement of the roller 16 and the angular position of the roller 16 relative to the photo detector 32 and the housing 11 to be precisely detected or measured.

In operation, the film material 80 will be supplied from the supply reel 13 to the take up reel 14, and will be engaged over or around the rollers 15, 16, 17, 18, and will be guided to move between the sealing device 22 and the container holder 21, for allowing the film material 80 to be forced to seal the containers by the sealing device 22, and the rotating movement of the roller 16 and the angular position of the roller 16 and thus the movement of the film material 80 relative to the photo detector 32 and the housing 11 may be precisely detected or measured with the detecting or measuring device 30, and the detecting or measuring device 30 may thus be formed and acted as a means for detecting or measuring the rotating movement of the roller 16 and the movement of the film material 80 relative to the photo detector 32 and the housing 11.

It is to be noted that the rotating movement of the roller 16 may be precisely detected or measured with the detecting or measuring device 30 without applying any marks or patterns or identification points onto the film material 80, such that various kinds of film material 80 may be selected and readily attached onto the lid sealing machine 10 in accordance with the present invention and may all be precisely detected or measured with the detecting or measuring device 30.

Accordingly, the lid sealing machine in accordance with the present invention includes a detecting or measuring device for detecting or measuring the movement or the position of film material and for allowing the film material to be precisely operated or cut to apply and to seal various recessed containers.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lid sealing machine comprising:

a housing including a seat, a casing attached to said housing, a sealing device disposed in said casing, a container holder for supporting containers to be sealed, said container holder being slidably attached to said housing and movable relative to said casing for moving the containers into and out of said casing, and a supply reel, a take up reel and at least one roller rotatably attached onto said housing for supporting a film material and for transmitting the film material from said supply reel around said at least one roller and to said take up reel, and for moving the film material between said sealing device and said container holder, and for allowing the film material to be forced to seal the containers by said sealing device, and said at least one roller being rotatably attached onto said seat of said housing, a photo detector attached to said seat of said housing, said photo detector including a groove formed therein, a rotary member secured to said at least one roller and rotated in concert with said at least one roller for acting with said photo detector, said rotary member including an outer peripheral portion movable into and through said groove of said photo detector, said rotary member including a plurality of slots formed in said outer peripheral portion of said rotary member to form a plurality of blades, said slots and said blades being alternatively and uniformly formed in said outer peripheral portion of said rotary member, and said outer peripheral portion of said rotary member being movable through said groove of said photo detector for detecting a rotating movement of said at least one roller and a movement of the film material relative to said housing.

* * * * *